United States Patent [19]

Lardellier

[11] 3,964,257

[45] June 22, 1976

[54] DEVICE FOR BOOSTING AND BLEEDING A GAS TURBINE ENGINE

[75] Inventor: Alain Marie Joseph Lardellier, Melun, France

[73] Assignee: Societe Nationale d'Etude et de Construction de Moteurs d'Aviation, France

[22] Filed: Feb. 7, 1975

[21] Appl. No.: 548,147

[30] Foreign Application Priority Data

Feb. 11, 1974 France ..... 74.04489

[52] U.S. Cl. ..... 60/226 R; 60/39.23; 415/28; 415/145

[51] Int. Cl.[2] ..... F02C 3/06; F02K 3/06

[58] Field of Search ..... 60/226 R, 39.07, 39.23, 60/226 A; 415/27, 28, 145

[56] References Cited

UNITED STATES PATENTS

| | | | |
|---|---|---|---|
| 2,958,457 | 11/1960 | Fox et al. | 415/27 |
| 3,108,767 | 10/1963 | Eltis et al. | 60/39.07 |
| 3,638,428 | 2/1972 | Shipley et al. | 60/226 R |
| 3,688,504 | 9/1972 | Hutchinson et al. | 60/226 R |

*Primary Examiner*—Carlton R. Croyle
*Assistant Examiner*—Robert E. Garrett
*Attorney, Agent, or Firm*—Watson, Cole, Grindle & Watson

[57] ABSTRACT

A boost and bleed device for a gas turbine engine comprising a primary duct through which a primary gas flow passes, and containing a low-pressure compressor and a high-pressure compressor which are independent of one another, and a secondary duct through which a secondary airflow passes. A main duct places in communication with the secondary duct that primary duct section which is comprised between the low-pressure compressor and the high-pressure compressor. This duct may be closed off by two flaps each of which contains an opening which itself may be closed off by a plate. Thus, even when said flaps are closed, an auxiliary duct exists which places the primary duct in communication with the secondary duct. The main duct makes it possible to boost the high-pressure compressor during the starting phase. The auxiliary duct makes it possible to bleed the low-pressure compressor during the acceleration phase.

14 Claims, 7 Drawing Figures

P2
21b
30b
27b
26b
26bb
9
31
10b
22b
46b
23b
10
41x
41
20b
45b
43b
24b
44b
47b
20
40
S
R
24a
48
49
43a
47a
44a
P0
P4
10a
22a
45a
42
46a
7
20a
26a
26aa
P3
23a
27a
30a
21a
φ

DEVICE FOR BOOSTING AND BLEEDING A GAS TURBINE ENGINE

BACKGROUND OF THE INVENTION

The present invention relates to a device for boosting and venting a gas turbine engine such as a gas turbine jet engine used for aircraft propulsion said engine being of the kind comprising at least two independent rotating stages, namely a low-pressure rotating stage comprising a low-pressure compressor, and a high-pressure rotating stage comprising a high-pressure compressor, said engine comprising a primary duct through which, in operation, there flows a primary air flow passing successively across the low-pressure compressor and the high-pressure compressor, said primary duct being separated by a casing, from an air space located outside the duct.

The boosting and venting device is of the kind which comprises:

at least one main duct starting in the primary duct section defined between the low-pressure compressor and the high-pressure compressor, and establishing communication, across said casing, between said primary duct section and said air space; and at least one main shutter element, movable in relation to said main duct and capable of occupying an open position, in which said main duct is open, and a closed position in which said main duct is closed.

The present invention relates more particularly, albeit not exclusively, to the case in which said gas turbine engine is of the dual-flow kind. The air space located outside the primary duct is then constituted by a secondary duct through which, in operation, there passes a secondary airflow coming from a fan secured to the low-pressure stage for rotation therewith, said fan being equipped, if required, with variable-pitch blades which are capable of going into reverse pitch.

The invention seeks in a general way to improve the operation of the engine in various critical operating phases: starting and acceleration of the engine, and braking of the aircraft by reversal of the fan-blade pitch.

It will be remembered, in this context, that the starting of dual-stage, dual-flow gas turbine engines (in particular engines in which the dilution ratio, that is to say the ratio between the secondary and primary airflows, has a high value), presents major difficulties. The low-pressure stage of these engines, which is equipped with a large-sized fan, is in other words difficult to start especially if, in the presence of a wind from the rear, the fan is already rotating in a direction which is the reverse of its normal direction of rotation. When the high-pressure stage is started, a certain amount of time consequently elapses before the low-pressure stage (and therefore the low-pressure compressor) starts to rotate in the proper direction. During all this time, the airflow available at the high-pressure compressor input, is very low and there is the possibility, on the one hand, of the compressor stalling, and on the other, of dangerous overheating taking place.

A phenomenon of this same sort occurs if, in order to produce aerodynamic braking of an aircraft by reversing the direction of the airflow through the secondary duct, the pitch of the fan-blades is reversed. In this case, too, the high-pressure compressor runs the risk of being starved.

In both the aforementioned instances, it can therefore be of interest to short-circuit the low-pressure compressor and to directly introduce fresh air to the high-pressure compressor input; this is the technique known as super charging or "boosting".

Conversely, it may happen that in order to avoid the possible risk of pumping of the low-pressure compressor, it is necessary to feed across this compressor an airflow which is in excess of that which can be absorbed downstream. The excess air must therefore be bled off at the compressor output. This is the technique known as compressor "bleeding".

Boosting and bleeding thus each employ the presence of a passage which, at the desired instant, will provide communication between the primary duct and an air space located outside said duct. It should be pointed out in this context that the cross-section of the bleed duct should be much smaller (in view of the relatively high pressure of the air which is to be bled off) than that of the boosting duct.

The present invention proposes a combined boost and bleed device, which is simple, light, relatively compact and inexpensive, capable of alternately performing the two functions, namely boosting the high-pressure compressor (during the phase of starting the engine or reversing the fanblades) and bleeding the low-pressure compressor (during the phase in which the engine is accelerating).

SUMMARY OF THE INVENTION

In accordance with the invention, a boost and bleed device designed for a gas turbine engine of the kind described in the preamble and comprising at least one main duct starting in the primary duct section located between the low-pressure compressor and the high-pressure compressor, and establishing communication across said casing, between said primary duct section and said air space; and at least one main shutter element which is movable in relation to said main duct and can occupy an open position in which said duct is open, and a closed position in which said duct is closed, is characterised in that it furthermore comprises at least one auxiliary duct formed across said main shutter element and likewise placing said primary duct section in communication with said air space; and at least one auxiliary shutter element, movable in relation to said auxiliary duct and capable of occupying an open position in which said auxiliary duct is open, and a closed position in which said auxiliary duct is closed. In the case of a dual-flow gas turbine engine comprising a secondary duct located outside the primary duct, said main and auxiliary ducts place said primary duct in communication with said secondary duct.

As will be seen at a later point in this description, the main duct does duty as a boost duct, whilst the auxiliary duct does duty as a bleed duct.

In accordance, still, with the invention, the boost and bleed device comprises, additionally, means which are sensitive to the difference between the pressures prevailing respectively in said primary duct and said air space (for example the secondary duct), and which are arranged, as required, to control said main shutter or said auxiliary shutter. Advantageously, furthermore, a locking mechanism will be provided which is designed to maintain said main shutter and said auxiliary shutter in their closed positions, as well as elements suitable to cancel the action of said blocking mechanism.

In accordance with a preferred embodiment, the main shutter element comprises, articulated to a fixed structure of the engine, in the neighbourhood of one edge of the main duct, a flap which contains as opening occupying part of its area. The auxiliary shutter element then consists of a plate articulated to the flap in the neighbourhood of one edge of said opening.

In accordance with a feature of the invention, applicable to this particular instance, the means which are sensitive to the difference between the pressures prevailing respectively in the primary duct and in the air space (for example the secondary duct) located outside said primary duct, comprise means which apply, to one of the faces of said flap and said plate, the pressure prevailing in said primary duct, and apply to the other face of said flap and said plate, the pressure prevailing in said air space.

The aforesaid locking mechanism may advantageously comprise, mounted on the fixed structure of the engine, an actuator such as a jack whose movable element is connected, through the medium of a transmission mechanism, to a lever fixed to the plate. Elastic means may also be provided in order to bias said plate into its closed position in which it closes off said opening.

In accordance with an advantageous feature of the invention, applicable to the case where the aforementioned casing has a hollow, double-walled structure, namely an internal wall in contact with the primary air flow and an external wall in contact with the said air space (for example the secondary airflow), the main duct extends across said hollow casing structure between two openings formed respectively in said walls. Two flaps (an internal flap and an external flap) each of which contains an opening occupying part of its area, then cooperate as shutters with respective ones of said openings, each of said flaps being articulated to a fixed structure of the engine, in the neighbourhood of one edge of the opening in question. Similarly, two plates (an internal plate and an external plate) then cooperate in a shutter relationship, with said respective openings, each of said flaps being articulated to the corresponding parent flap in the neighbourhood of one edge of the opening in question. Means such as toothed sectors are provided, furthermore, in order to synchronize on the one hand the motions of said internal and external flaps, and on the other hand the motions of said internal and external plates.

BRIEF DESCRIPTION OF THE DRAWINGS

The invention will now be further described, by way of example only, with reference to the accompanying drawings, in which.

DESCRIPTION OF PREFERRED EMBODIMENTS

Figure 1:
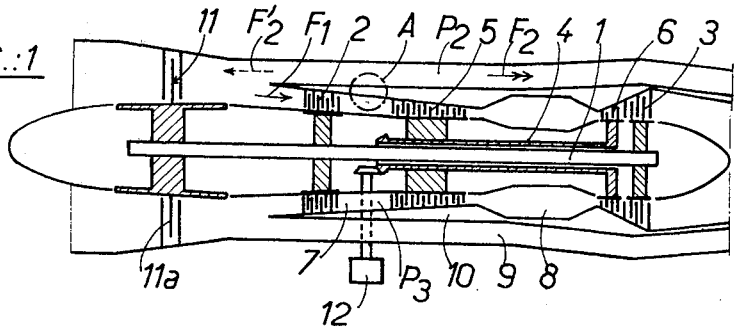
FIG. 1 shows a schematic illustration in longitudinal section, of a dual-stage, dual-flow turbojet engine which may be equipped with a boost and bleed device in accordance with the invention.

In FIG. 1, a gas turbine engine (for example a gas turbine jet engine designed for aircraft propulsion applications), of the kind incorporating two independent rotating stages, namely a low-pressure stage and a high-pressure stage, is shown. The low-pressure rotating stage comprises, linked together by a shaft 1, a low-pressure compressor 2 and a low-pressure turbine 3. Similarly, the high-pressure rotating stage comprises, linked together by a shaft 4, a high-pressure compressor 5 and a high-pressure turbine 6. The engine has a primary duct 7 through which, in operation, a primary airflow $F_1$ flows, passing successively through the low-pressure compressor 2 and the high-pressure compressor 5. This primary flow is then heated in a combustion chamber 8 and then successively flows across the high-pressure turbine 6 and the low-pressure turbine 3, before being discharged through the primary flame tube (not shown).

An air space 9 is located outside the primary duct 7 and separated therefrom by a casing 10.

In the example illustrated, the gas turbine engine is a dual-flow turbojet engine comprising a secondary duct which comprises the aforesaid air space 9. In normal operation, the secondary duct 9 carries a secondary flow $F_2$ which passes across a secondary flame tube (not shown). This secondary flow is produced at the same time as the primary flow, by a fan 11 located on an extension of the shaft 1 so that it rotates together with the low-pressure stage 1-2-3.

The reference 12 designates a starter coupled to the shaft 4 by means of a suitable transmission system and making it possible to spin-up the high-pressure stage 4-5-6.

As described above, starting this kind of dual-stage, dual-flow turbojet engine presents difficulties. In other words, when a dual-stage turbojet engine is being started up, normally it is only the high-pressure stage 4-5-6 which is subjected to the action of the starter 12. Over a certain period of time which follows the actuation of the starter, the low-pressure stage 1-2-3 accelerates only slowly so that throughout this time, the airflow available at the input of the high-pressure compressor 5 and coming from the low-pressure compressor 2, remains weak. This can lead to the risk of stalling of the high-pressure compressor and dangerous overheating. This phenomenon is the more marked if, in the presence of a wind from the rear (that is to say in the direction $F'_2$) blowing through the secondary flame tube, the fan 11 initially drives the low-pressure stage in the direction which is the opposite to its normal direction of rotation.

A phenomenon of this same kind can also occur on landing. Those skilled in the art will be aware, in other words, that it is possible in the case where the fan 11 is equipped with variable and indeed reversible pitch blading 11*a*, to achieve aerodynamic braking of the aircraft by reversing the direction of airflow through the secondary duct 9, this air then flowing in the direction $F'_2$. To do this, it is merely necessary to reverse the pitch of the blades 11*a* of the fan. However, there again, the result is that the air-flow available at the input of the high-pressure compressor 5 is very much reduced and this gives rise to the same sorts of drawbacks as are encountered during starting.

A first object of the present invention, therefore, is to furnish a device which is capable, when necessary, of effecting boosting, that is to say direct feeding, of the high-pressure compressor 5 with fresh air taken from the air space or secondary duct 9.

Conversely, it may happen that in order to avoid the risk of possible pumping of the low-pressure compressor 2, the airflow leaving the latter is in excess of the rate which can be handled by the engine system further downstream.

A second object of the invention, therefore, is to provide a device which makes is possible, where necessary, to bleed, that is to say evacuate, the excess flow leaving the low-pressure compressor 2, this bleed likewise being effected towards the air space or secondary duct 9.

The combined boost and bleed device in accordance with the present invention makes it possible, at the desired instant, to establish communication across the casing 10, between the primary duct section 7 disposed between the low-pressure compressor 2 and the high-pressure compressor 5, and the air space or secondary duct 9. This device, which has been schematically illustrated in FIG. 1 by the reference A, will now be described in detail with reference to FIGS. 2 to 6.

In FIGS. 2 to 6, there is shown the casing 10 which separates from one another the primary duct 7 and the air space or secondary duct 9. In the example illustrated, the casing 10 which forms part of a fixed structure of the engine, has a hollow double-walled structure 20 comprising an internal wall 10*a* in contact with the primary flow $F_1$, and an external wall 10*b* in contact with the air space 9.

The device in accordance with the invention comprises at least one main duct 20*a*-20-20*b* starting in the primary duct section 7 located between the compressors 2 and 5, and establishing communication across the hollow casing structure 20, between said primary duct section and the air space or secondary duct 9. Preferably, several (for example twelve) identical main ducts will be distributed all around said primary duct section, at regular angular intervals.

Each main ducts extends transversely to the longitudinal axis of the engine, across the hollow casing structure 20, between two openings 20*a*, 20*b* (see FIG. 4) formed respectively in the casing walls 10*a*, 10*b*.

With each main ducts 20*a*-20-20*b*, there is associated a main shutter element which is movable in relation to said main duct and can occupy an open position (see FIG. 5) in which said main duct is open, and a closed position (see FIG. 4) in which said main duct is closed. In the example illustrated, namely that of a casing structure 10 of double-walled design, the main shutter element comprises two flaps, namely an internal flap 21*a* and an external flap 21*b*, which cooperate in a shutter relationship respectively with the openings 20*a* and 20*b*.

Each flap 21*a* or 21*b* is articulated to the casing 10 in the neighbourhood of one edge of the relevant opening, about a fixed rivet 22*a* or 22*b* disposed substantially tangentially to the primary duct 7, and rests, in the closed position, against a stop 23*a* or 23*b* as the case may be, integral with said casing. Means are provided in order to synchronize the motions of the two flaps 21*a* and 21*b*. In the example illustrated, these means comprise tooth sectors 24*a*, 24*b* in engagement with one another and fixed respectively to said two flaps (see, in particular, FIG. 2).

Figure 7:
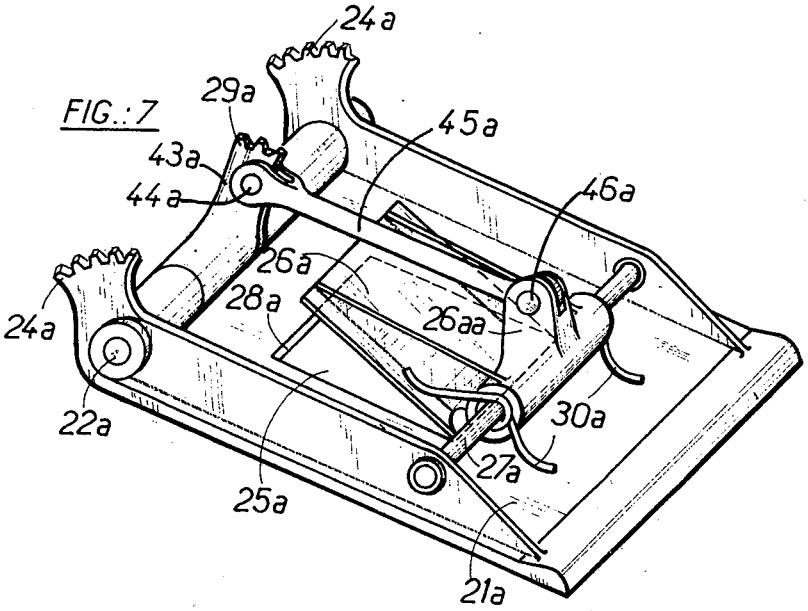
FIG. 7 is a schematic perspective view illustrating a boost flap and a bleed plate, forming part of the device shown in FIGS. 2 to 6.
Figure 2:
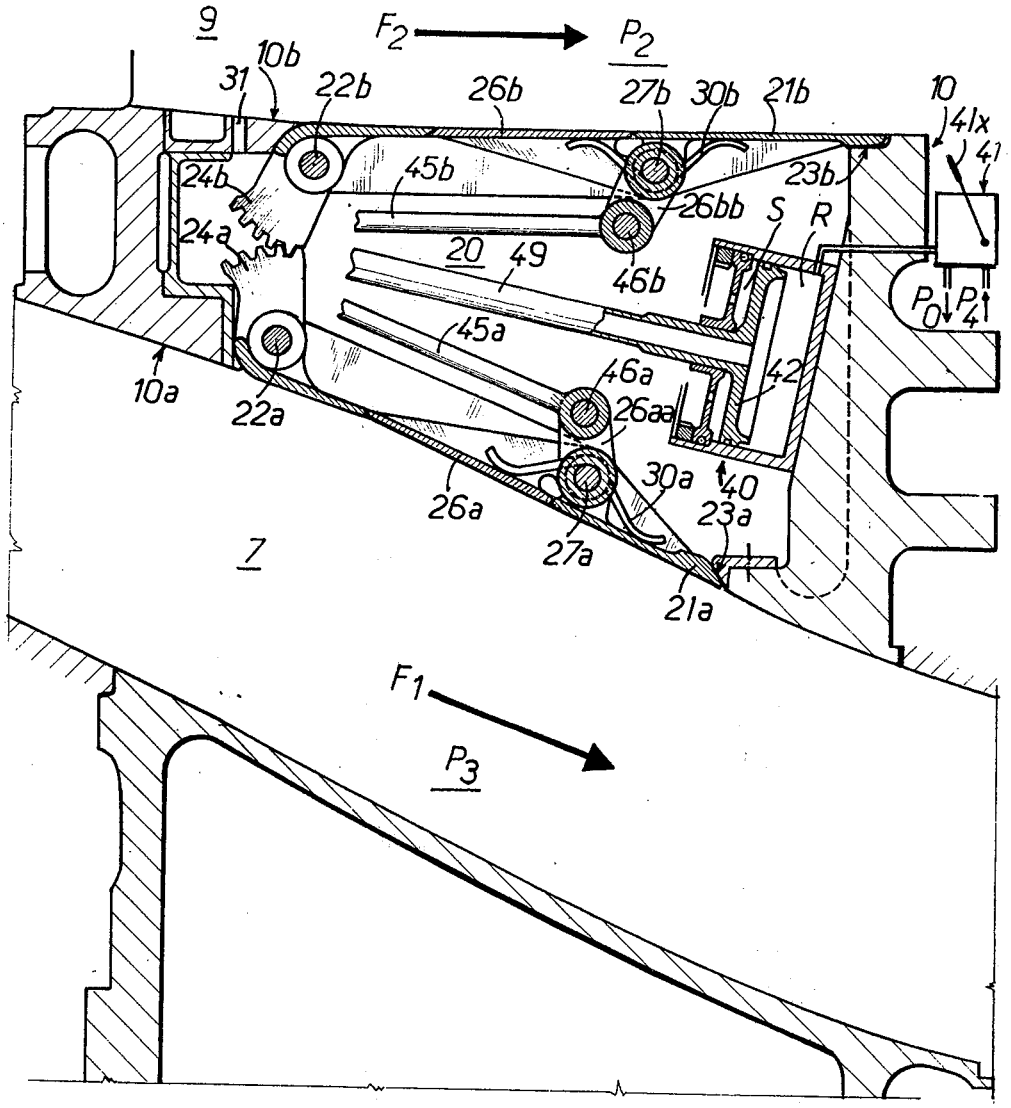
FIGS. 2 and 3 are two longitudinal sectional views, partially cut-away, of a boost and bleed device in accordance with the invention.
Figure 3:
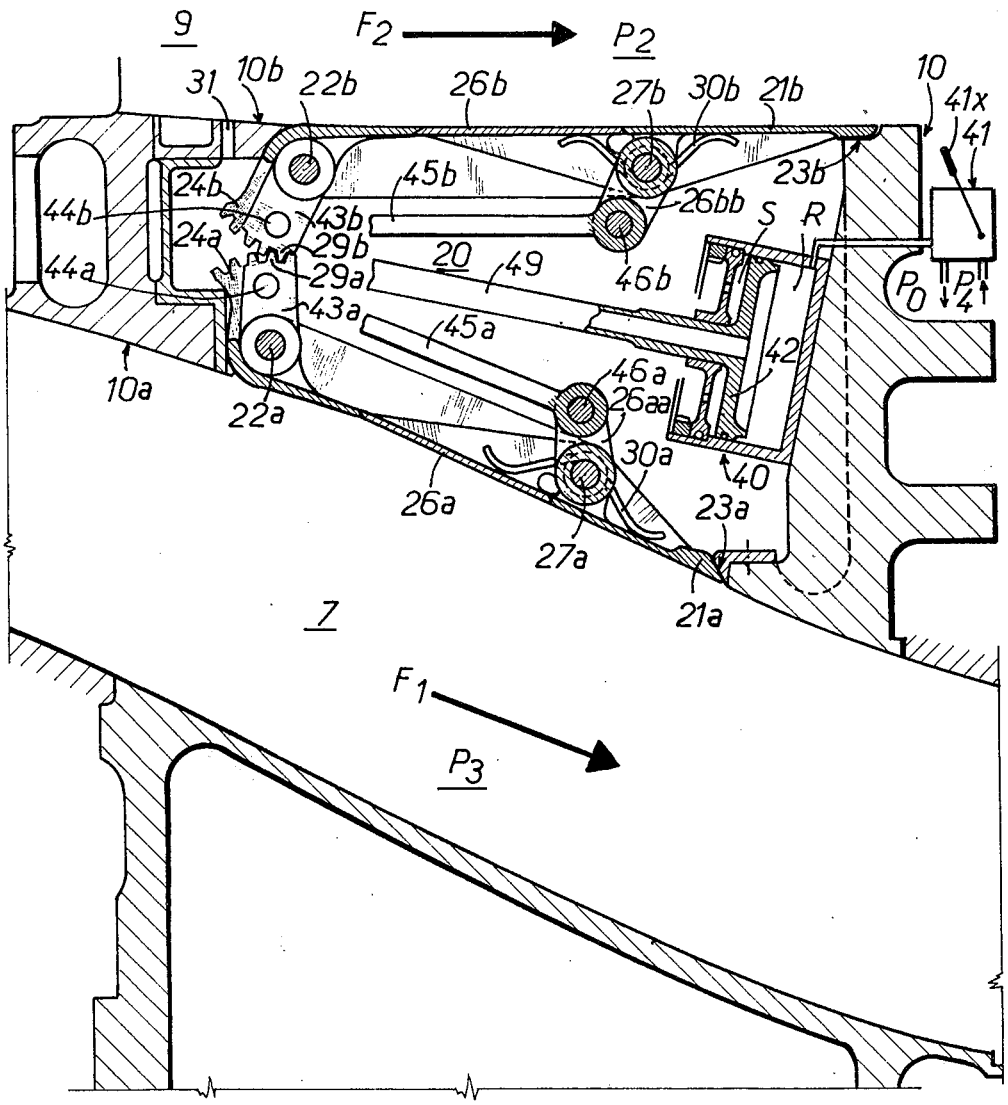

Each flap 21*a* or 21*b* contains an opening 25*a* or 25*b* (see in particular FIGS. 6 and 7), which occupies part of its area. The assembly of these two openings forms part of an auxiliary duct formed across the main shutter 21*a*, 21*b*, this auxiliary duct likewise enabling communication to take place between the aforesaid primary duct section 7 and the air space or secondary duct 9. It will be observed that the cross-sectional area offered to the airflow through said auxiliary duct 25*a*-20-25*b* is substantially less than that offered by the main duct 20*a*-20-20*b*.

With each auxiliary ducts 25*a*-20-25*b*, there is associated an auxiliary shutter element which can move in relation to said auxiliary duct and occupy an open position (see FIG. 6) in which said auxiliary duct is open, and a closed position (see FIG. 4) in which said auxiliary duct is closed. In the example illustrated, namely that of a main shutter element constituted by two flaps 21*a*, 21*b*, each containing an opening 25*a*or 25*b* as the case may be, the auxiliary shutter element comprises two plates, namely an internal plate 26*a* and an external plate 26*b*, cooperating in a shutter relationshhip with the respective openings.

Each plate 26*a* or 26*b* is articulated to the correpsonding flap 21*a* or 21*b* in the neighbourhood of one edge of the opening in question, about a pivot 27*a* or 27*b*, respectively, carried by said flap and disposed substantially tangentially to the primary duct 7, and rests, when in the closed position, against a stop 28*a* or 28*b*, integral with the corresponding flap. Means are provided in order to synchronize the motions of the two plates 26*a* and 26*b*. In the example illustrated, these synchronizing means comprise toothed sectors 29*a*, 29*b* which mesh with one another and are carried by elements which will be described in more detail hereinafter (see in particular FIG. 3).

Elastic means, such as springs 30*a* and 30*b* bearing on the one hand against the flaps 21*a* and 21*b* and on the other against the plates 26*a* and 26*b*, respectively bias said plates into their closed positions, in which they respectively close off the corresponding openings 25*a* and 25*b*.

The hollow casing structure 20 communicates with the air space or secondary duct 9 through the agency of means such as orifices 31, so that in operation the pressure prevailing inside said casing structure (that is to say the pressure prevailing between the two flaps 21*a* and 21*b*) is substantially equal to that prevailing in said air space 9.

The main shutter and auxiliary shutter (which, in the example illustrated, are respectively constituted by the assembly of two flaps 21*a* and 21*b*, and the assembly of two plates 26*a* and 26*b*), can both be maintained in their closed positions by a locking mechanism 40 the action of which can be cancelled with the help of means 41 which will be described later.

In the example illustrated, the locking mechanism 40 comprises an actuator located inside the casing stucture 10 and carried by same. This actuator has a movable element such as a piston 42, connected, through the medium of a transmission mechanism, to two levers 26*aa* and 26*bb* respectively fixed to the internal plate 26*a* and to the external plate 26*b*.

The aforesaid transmission mechanism comprises, in particular, two rocker arms 43*a* or 43*b* articulated to the fixed structure of the casing, one about a pivot coincidental with the pivot 22*a* of the internal flap 21*a*, and the other about a pivot coincidental with the pivot 22*b* of the external flap 21*b*. To each of these rocker arms there is articulated, about a pivot 44*a* or 44*b* as the case may be, one of the ends of a link 45*a* or 45*b* whose other end is articulated, about a pivot 46*a*or 46*b*, to the plate lever 26*aa* or 26*bb* as the case may be. To each of these rocker arms there is furthermore articulated, about the same pivot 44*a* or 44*b*, one of the ends of a lever 47*a* or 47*b* whose other end is articulated, about a pivot 48, to a control rod 49 integral with the mobile element or piston 42 of the actuator 40.

The toothed sectors 29*a* and 29*b* which engage with one another and ensure synchronization of the motions of the two plates 26*a* and 26*b*, are respectively integral with the aforesaid rocker arms 43*a* and 43*b*.

It will be observed that the quadrilateral figure formed by the respective projections on the plane of the figure, of the pivots 22*a*, 44*a*, 46*a*, 27*a* (or 22*b*, 44*b*, 46*b*, 27*b*), is substantially a parallelogram exhibiting a point 22*a* (or 22*b*) which is fixed in relation to the casing structure 10.

Figure 4:
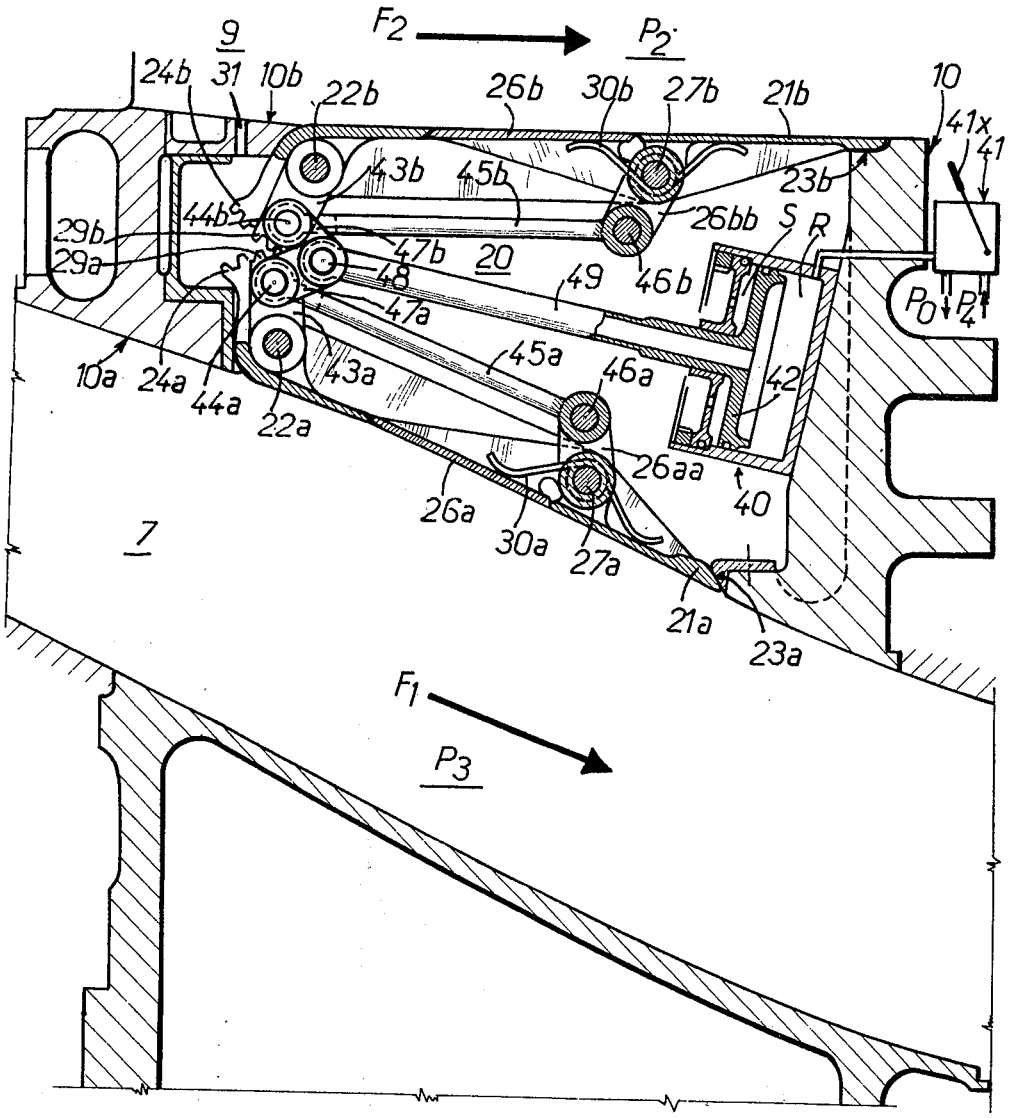
FIG. 4 is a view identical to that of FIGS. 2 and 3, but without the partial cut-away, of the boost and bleed device in accordance with the invention, the device having been shown in the non-boosting and non-bleeding configuration.
Figure 5:
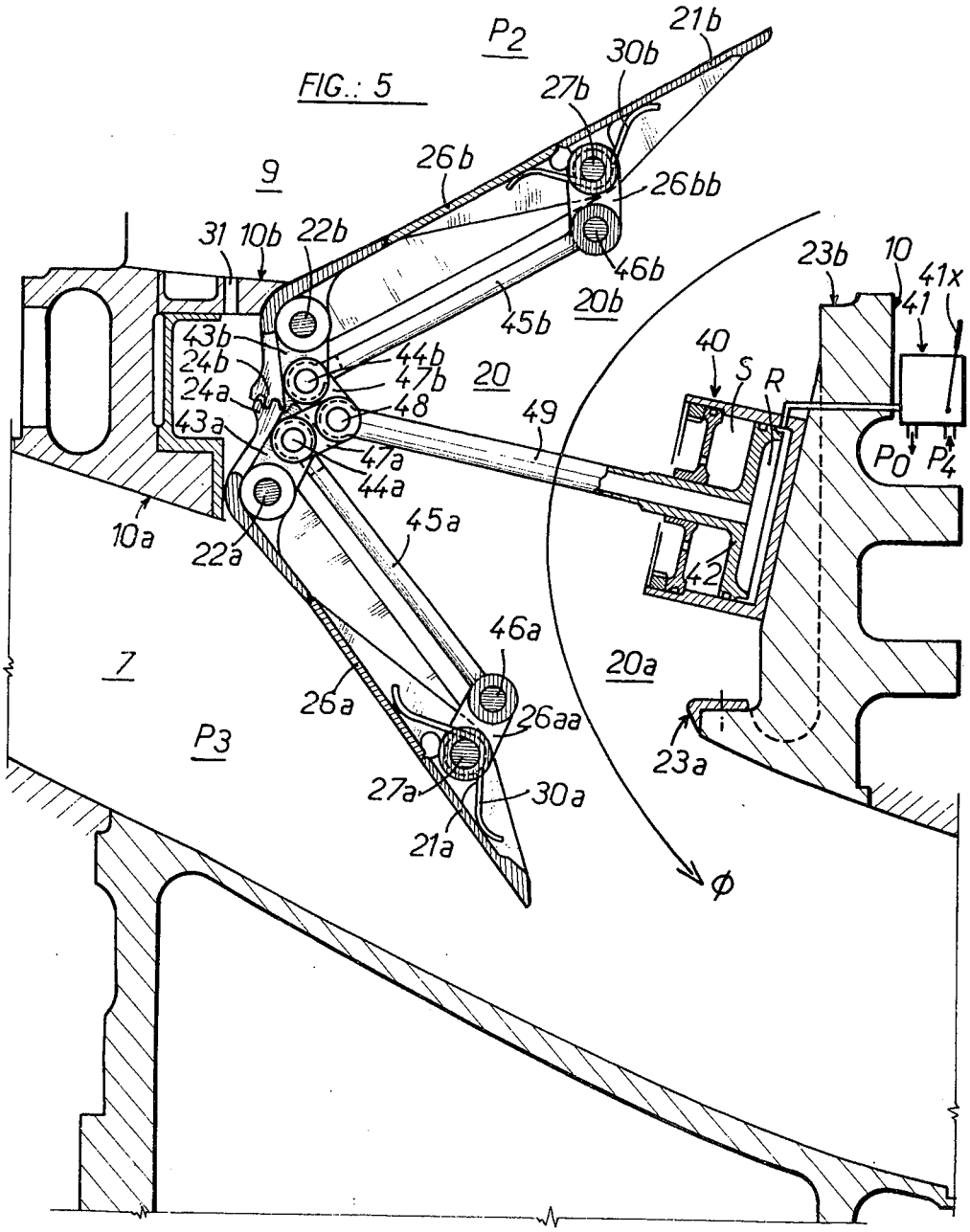
FIG. 5 is a view similar to that of FIG. 4, illustrating the device in the boost configuration.

This parallelogram can pivot (without distorting) about the fixed point 22*a* (or 22*b*), in order to move from the position shown in FIG. 4 to the position shown in FIG. 5. It can also distort (without pivoting about the point 22*a* or 22*b*) in order to move from the position shown in FIG. 4 to the position shown in FIG. 6. Finally, it can also pivot about the point 22*a* (or 22*b*) and deform.

The actuator 40 may be of any desired type: electrical, hydraulic or pneumatic. In the example illustrated, it is constituted by a pneumatic actuator in the form of a jack divided into two chambers R and S by the piston 42. The chamber R of the jack can be placed into communication, through the medium of a valve 41 equipped with a control lever 41*x*, either with a source of fluid at realtively high pressure $P_4$ (for example a compressed air take-off located at the output of the high-pressure compressor 5), or with a source of fluid at low pressure $P_0$.

In the following, $P_2$ will be used to designate the pressure prevailing in the air space or secondary duct 9 and $P_3$ the pressure prevailing in the primary duct 7, between the the low-pressure compressor 2 and the high-pressure compressor.

An important feature of the present invention resides in the presence of means which are sensitive to the difference between the pressures $P_2$ and $P_3$ and which control, as required, the main shutter 21*a*–21*b* or the auxiliary shutter 26*a*–26*b*.

In the example illustrated, these means are constituted by the choice of the disposition of internal flap 21*a* and internal plate 26*a*. As can be seen, the flap and the plate are subjected on one of their faces to the pressure $P_3$prevailing in the primary duct 7, and on the other of their faces to the pressure prevailing inside the hollow structure of the casing 20, this pressure (by reason of the presence of the orifices 31) being substantially equal to the pressure $P_2$ prevailing in the air space or secondary duct 9.

If the locking mechanism described above is disregarded, this comprising, in particular, the actuator 40 and the transmission mechanism 49–47*a* (47*b*)–43*a* (43*b*)–45*a*–(45*b*) associated therewith, then the flap 21*a* and the plate 26*a* will tend to pivot about their respective pivots 22*a* or 27*a* under the action of the difference between the aforesaid pressures.

Two cases can then arise, depending upon whether the pressure $P_3$ is greater than or less than the pressure $P_2$.

In the first case, the assembly constituted by the flap 21*a* and the plate 26*a* will tend to pivot about the pivot 22*a* in order to occupy the position shown in FIG. 5. simultaneously, the assembly constituted by the flap 21*b* and the flap 26*b* will pivot about the pivot 22*b*, due to the presence of the toothed synchronizing sectors 24*a*, 24*b*.

Figure 6:
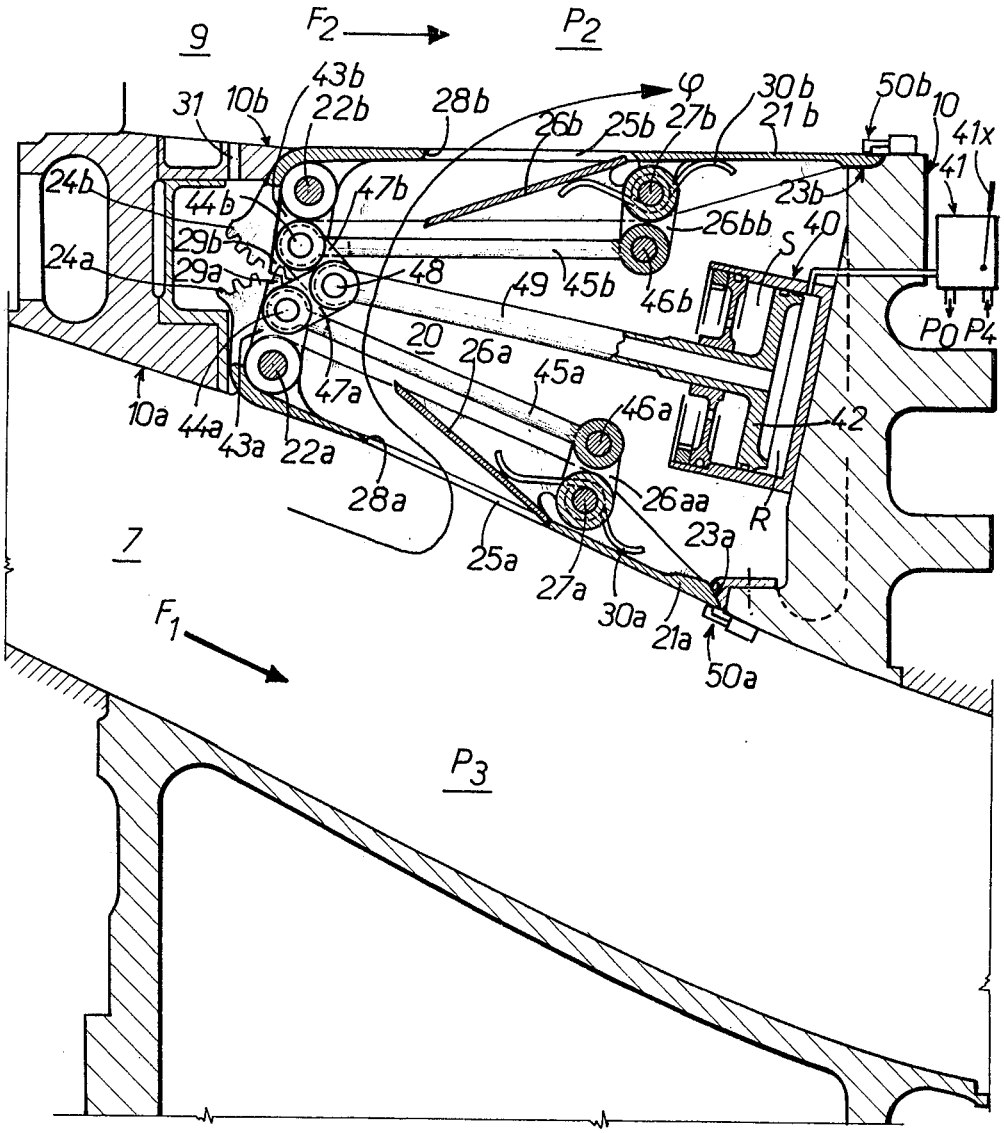
FIG. 6 is a view similar to FIGS. 4 and 5 illustrating the device in the bleed configuration.

In the second case, the plate 26*a* will tend to pivot in relation to the flap 21*a* about the pivot 27*a* in order to occupy, against the action of the spring 30*a*, the position shown in FIG. 6. Simultaneously, the plate 26*b* will pivot in relation to the flap 21*b* about the pivot 27*b*, thanks to the presence of the toothed synchronizing sectors 29*a*, 29*b*.

The combined boost and bleed device which has been described, operates in the following manner, the assumption being made that it is fitted to a dual-stage, dual-flow turbojet engine used in an aircraft. 3

In normal cruising flight (see FIG. 4), the control lever 41*x* for the valve 41, is in the position in which the chamber R of the actuator or jack 40, is supplied with fluid at high pressure $P_4$. The mobile element or pistor 42 of the actuator then, through the intermediary of the transmission system 49–47*a* (47*b*)–43*a*(43*b*)–45*a* (45*b*) displaces both the two flaps 21*a*, 21*b* and the two plates 26*a*, 26*b*, into their closed positions so that communication between the primary duct 7 and the secondary duct 9 across the casing 10, is cut off. It will be observed, in this context, that the closing action which has just been described always substantially outweighs any opening action on the part of the flaps 21*a*–21*b* or plates 26*a*–26*b*, whatever the value and sign of the pressure difference $P_3 - P_2$. The actuator 40 and the transmission mechanism associated with it, thus in fact together constitute a locking system suitable to maintain the main shutter 21*a*–21*b* and the auxiliary shutter 26*a*–26*b*, in their closed positions.

At the time of start-up of the gas turbine jet engine (see FIG. 5), the control lever 41*x* of the valve 41 is placed in the position in which the chamber R of the actuator or jack 40 communicates with the source of fluid at low pressure $P_0$, so that the mobile element or piston 42 of the actuator 40 is now free to slide towards the right (in the Figure). The valve 41 thus constitutes a means which is suitable to cancel the action of the aforesaid locking mechanism.

As described earlier, at the time of start-up, only the high-pressure stage 4-5-6 is rotated by the starter 12, whilst the low-pressure stage only picks up speed in a progressive way, under the action of the gases flowing across the low-pressure turbine 3. During a certain time, everything happens as if the low-pressure compressor 2 and the fan 1 were more or less impermeable to the airflow. The result is that the airflow available at the input of the high-pressure compressor 5 is insufficient and it is necessary to carry out boosting, that is to say to directly supply fresh air to this compressor.

The high-pressure stage having been spun-up, there develops at the input of the high-pressure compressor 5 a vacuum produced by the sucking in of air by said compressor. In addition, the secondary duct 9 behaves as an air reservoir in which the flow velocity is virtually zero. The pressure $P_3$ prevailing at this instant in the primary duct 7, between the low-pressure compressor 2 and the high-pressure compressor 5, is then very much lower than the pressure $P_2$ prevailing at the same instant in the secondary duct 9.

Under the action of the vacuum ($P_3$–$P_2$), the flap 21*a* therefore tends to open, displacing the mobile element 42 of the actuator 40 into its extreme position as shown in FIG. 5. Simultaneously, the flap 21*b* opens due to the synchronizing action of the toothed sectors 24*a*, 24*b* and the control rod 49. The primary duct 7 and the air space or secondary duct 9, are thus placed in communication with the main duct 20*a*-20-20*b* so that an airflow $\phi$ tapped off from the secondary duct 9 makes it possible to boost, that is to say directly feed, the high-pressure compressor 5.

It will be observed that in the open position, the flap 21*a* partially closes off the primary duct 7 but this constitutes no drawback as far as boosting is concerned, due to the fact that the low-pressure compressor 2 is virtually impermeable to the airflow during this phase.

As the low-pressure stage 1-2-3 speeds up, the pressure $P_3$ in the primary duct increases and ultimately becomes higher than the pressure $P_2$ existing in the secondary duct. The flaps 21*a* and 21*b* therefore progressively close again. The closing motion of the flaps may if required be assisted by resupplying the chamber R of the jack 40, with fluid at high pressure $P_4$. This procedure also has the advantage of making it possible to seat the plates 26*a*, 26*b* positively against their flaps 21*a*, 21*b* and said flaps in turn against their stops 23*a*, 23*b*, this even in the event of any backlash in the synchronizing mechanisms 24*a*–24*b* and 29*a*–29*b*, and in the transmission system 49–47*a* (47*b*)–43*a* (43*b*)–45*a* (45*b*).

It will be observed that during the motion of the flaps 21*a* and 21*b*, the plates 26*a* and 26*b* associated with them, remain closed due to the action of the springs 30*a* and 30*b*.

During the phase of aerodynamic braking of the aircraft by reversal of the pitch of the blading 11*a* of the fan 11, the control level 41*x* of the valve 41 is likewise placed in the position shown in FIG. 5, where the actuator 40 does not oppose any opening motion of the flaps 21*a*, 21*b* which may take place.

As described earlier, in this case too there exists the risk that the high-pressure compressor 5 will receive an insufficient air supply from the low-pressure compressor 2. Under these conditions, opening of the boost flaps 21*a*, 21*b*, in the situation where the pressure $P_3$ becomes lower than the pressure $P_2$, ensures direct supplying of the high-pressure compressor with air tapped off from the secondary duct 9.

During the phase of acceleration of the turbojet engine (see FIG. 6), the control lever 41*x* of the valve 41 is placed in the position in which the chamber R of the actuator or jack is in communication with the source of fluid at low pressure $P_0$, so that the mobile element or piston 42 of the actuator is free to slide towards the right (in the Figure).

As mentioned, the airflow available at the output of the low-pressure compressor 2 during this phase, may be instantaneously higher than the flow which it is possible to absorb downstream of the compressor. This runs the risk of pumping the compressor.

In this condition, the pressure $P_3$ at the output of the low-pressure compressor is very much higher than the pressure $P_2$ in the secondary duct 9 so that the pressure difference ($P_3$–$P_2$) is sufficient to overcome the action of the springs 30*a*, 30*b* as well as of the friction resistance in actuator 40 and transmission mechanism 49–47*a*(47*b*)–43*a*(43*b*)–45*a*(45*b*). The plate 26*a* opens as a consequence, displacing the mobile element 42 of the actuator towards its extreme position as shown in FIG. 6. simultaneously, the plate 26*b* opens due to the synchronization of the motions, produced by the tooth sectors 29*a*–29*b* and the control rod 49.

The primary duct 7 and the air space or secondary duct 9 are thus placed in communication across the auxiliary ducts 25*a*-20-25*b* so that an airflow $\phi$ coming from the primary duct 7 is bled across said duct towards the air space or secondary duct 9, enabling the low-pressure compressor 2 to be bled and thus preventing any risk of it being pumped.

To halt the bleed operation, it is merely necessary to place the chamber R of the actuator in communication again with the source of fluid at high pressure $P_4$. The assembly of flaps 21*a*, 21*b* and plates 26*a*, 26*b* then returns to the configuration shown in FIG. 4.

Different variations of the embodiment described, are of course possible within the scope of the invention.

Thus, for example, instead of utilising by way of actuator 40 a single-acting pneumatic jack, it would be equally possible to utilise a double-acting pneumatic jack or hydraulic jack.

In particular, a double-acting hydraulic jack would make it possible to positively control the boost flaps 21*a*, 21*b* (or the bleed plates 26*a*, 26*b*), in both the opening direction (by the admission of hydraulic fluid under pressure, into the chamber S of the jack), and in the closing direction (by the admission of hydraulic fluid under pressure into the chamber R of the jack).

It will be noted, furthermore, that in the embodiment more particularly described here, the travel of the control rod 49 is the same where the function of opening the flaps 21*a*, 21*b* is concerned, as it is for the plates 26*a*, 26*b*. This does not of course mean to say that it is necessary to ensure that the flaps 21*a*, 21*b* are completely closed, before the plates 26*a*, 26*b* can be opened. In other words, it might well happen that the opening of the plates commences whilst the flaps are still partially open. This feature could possibly be exploited, at the end of the starting phase, in order to make the springs 30*a*, 30*b* act to damp any bounce effects on the part of the flaps when these latter are biased into the closing position by the rise of pressure in the primary duct 7.

In another arrangement, it might be desirable for the bleed plates 26*a*, 26*b* to be able to open only when the flaps 21*a*, 21*b* have completely closed. It will then be necessary to arrange a locking device for these flaps, which is operated once the starting phase has terminated. A locking device of this kind has been shown schematically in FIG. 6 in the form of two latches 50*a*, 50*b* arranged, for example, at the location of the stops 23*a*, 23*b*.

In the embodiment described herein, it has been assumed that the main shutter and the auxiliary shutter were constituted respectively by a set of two flaps 21*a*, 21*b* and two plates 26*a*, 26*b*. However, it would readily be possible to employ a different construction. The main flap, for example, could comprise simply a single flap, such as that 21*a*, equipped with a plate 26*a*. In addition, the pivoting flaps or plates, could be replaced by shutter elements of some other kind, as for example sliding gates.

The embodiment described is purely an example and is open to modification without in so doing departing from the scope of the present invention as defined in the claims.

I claim:

1. A device for boosting and bleeding a gas turbine engine such as a gas turbine jet engine used for aircraft propulsion, said engine being of the kind comprising at least two independent rotating stages, namely a low-pressure rotating stage comprising a low-pressure compressor, and a high-pressure rotating stage comprising a high-pressure compressor, said engine comprising a primary duct through which, in operation, there flows a primary airflow passing successively across the low-pressure compressor and the high-pressure compressor, said primary duct being separated by a casing, from an air space located outside the duct, said device for boosting and venting comprising at least one main duct starting in the primary duct section defined between the low-pressure compressor and the high-pressure compressor, and establishing communication, across said casing, between said primary duct section and said air space and, at least one main shutter element, movable in relation to said main duct and capable of occupying an open position, in which said main duct is open, and a closed position in which said main duct is closed, at least one auxiliary duct formed across said main shutter element and likewise placing said primary duct section in communication with said air space, and at least one auxiliary shutter element movable in relation to said auxiliary duct and capable of occupying an open position in which said auxiliary duct is open, and a closed position in which said auxiliary duct is closed which auxiliary shutter element is part of said main shutter element.

2. A device as claimed in claim 1 for a dual-flow gas turbine engine of the kind in which said air space located outside the primary duct is constituted by a secondary duct through which, in operation, there passes a secondary airflow emitted by a fan secured for rotation to the low-pressure stage, wherein said main and auxiliary ducts place said primary duct in communication with said secondary duct.

3. A device as claimed in claim 1, further comprising a locking mechanism suitable to maintain said main shutter and said auxiliary shutter in their closed positions, and means designed to cancel the action of said locking mechanism.

4. A device as claimed in claim 1, wherein said main shutter element comprises, articulated to a fixed structure of the engine, in the neighbourhood of one edge of said main duct, a flap containing an opening occupying part of its area, and wherein said auxiliary shutter comprises a plate articulated to said flap in the neighbourhood of one edge of said opening.

5. A device as claimed in claim 1, wherein said main shutter element comprises, articulated to a fixed structure of the engine in the neighbourhood of one edge of said main duct, a flap containing an opening occupying part of its area, and wherein said auxiliary shutter comprises a plate articulated to said flap in the neighbourhood of one edge of said opening and wherein the means sensitive to the difference between the pressures prevailing respectively in the primary duct and in the air space located outside said primary duct, comprise means for applying to one of the faces of said flap and said plate the pressure existing in said primary duct, and for applying to the other face of said flap and said plate, the pressure existing in said air space.

6. A device as claimed in claim 5, further comprising a locking mechanism suitable to maintain said main shutter and said auxiliary shutter in their closed positions, and means designed to cancel the action of said locking mechanism, wherein the locking mechanism comprises, mounted on the fixed structure of the engine, an actuator comprising a jack whose mobile element is connected, through the medium of a transmission mechanism, to a lever integral with said plate.

7. A device as claimed in claim 6, wherein said transmission mechanism comprises a rocker arm articulated to the fixed structure of the engine, about a pivot coincidental with the pivot of the corresponding flap.

8. A device as claimed in claim 4, further comprising elastic means biasing said plate to its closed position, in which it closes off said opening.

9. A device as claimed in claim 4, further comprising a latch for holding said flap in the closed position.

10. A device as claimed in claim 1, for an engine in which said casing has a hollow, double-walled structure, namely an internal wall in contact with said primary airflow and an external wall in contact with said air space, wherein said main duct extends across said hollow casing structure between two openings formed respectively in said walls; wherein said main shutter element comprises two flaps, an internal flap and an external flap, cooperating in a shutter relationship respectively with said openings, each of said flaps being articulated to a fixed structure of the engine, in the neighbourhood of an edge of the respective opening, and containing an opening occupying part of its area; and said auxiliary shutter element comprises two plates, an internal plate and an external plate, cooperating in a shutter relationship respectively with said further openings, each of said plates being articulated to the corresponding flap in the neighbourhood of an edge of the respective opening, and wherein said device further comprises means synchronizing the movements of said internal flaps and external flaps and the movements of said internal plates and external plates.

11. A device as claimed in claim 10, comprising means which place said hollow casing structure in communication with the air space located outside said primary duct and means sensitive to the difference between the pressures prevailing respectively in said primary duct and said air space, in order to control said main shutter and said auxiliary shutter, and wherein the means sensitive to the difference in the pressures existing respectively in the primary duct and in the air space located outside said primary duct comprise means for applying to one of the faces of said internal flap and said internal plate the pressure existing in said primary duct, and for applying to the other face of said flap and said plate, the pressure existing inside said hollow casing structure, which pressure is substantially equal to that existing in the air space located outside said primary duct.

12. A device as claimed in claim 11, further comprising a locking mechanism suitable to maintain said main shutter and said auxiliary shutter in their closed positions, and means designed to cancel the action of said locking mechanism, wherein said locking mechanism comprises, mounted upon the fixed structure of the engine, and actuator such as a jack whose mobile element is connected, through the medium of a transmission mechanism, to two levers respectively integral with the internal plate and the external plate.

13. A device as claimed in claim 12, wherein said transmission mechanism comprises two rocker arms articulated to the fixed structure of the engine, one about a pivot coincidental with the pivot of the internal flap, and the other about a pivot coincidental with the pivot of the external flap.

14. A device as claimed in claim 13, wherein the means for synchronizing the internal flap and the external flap associated with the same main duct comprise two toothed sectors engaging with one another and integral respectively with said flaps; and wherein the means for synchronizing the two plates fitted respectively to said two flaps comprises two other toothed sectors engaging with one another and integral respectively with the two rocker arms which form part of the transmission mechanism associated with said plates.

* * * * *